United States Patent [19]

Hiraga et al.

[11] 4,432,708

[45] Feb. 21, 1984

[54] SCROLL-TYPE FLUID DISPLACEMENT APPARATUS WITH PRESSURE COMMUNICATING PASSAGE BETWEEN POCKETS

[75] Inventors: Masaharu Hiraga, Honjyo; Seiichi Sakamoto, Gunma, both of Japan

[73] Assignee: Sanden Corporation, Gunma, Japan

[21] Appl. No.: 277,108

[22] Filed: Jun. 25, 1981

[30] Foreign Application Priority Data

Jul. 1, 1980 [JP] Japan ..... 55-90390

[51] Int. Cl.[3] ..... F01C 1/02

[52] U.S. Cl. ..... 418/55; 418/75

[58] Field of Search ..... 418/55, 59, 61 R, 75, 418/77, 78

[56] References Cited

U.S. PATENT DOCUMENTS

| | | | |
|---|---|---|---|
| 3,884,599 | 5/1975 | Young et al. | 418/55 |
| 4,192,152 | 3/1980 | Armstrong et al. | 62/402 |
| 4,216,661 | 8/1980 | Tojo et al. | 62/505 |
| 4,343,599 | 8/1982 | Kousokabe | 418/55 |
| 4,383,805 | 5/1983 | Teegarden et al. | 418/55 |

FOREIGN PATENT DOCUMENTS

| | | | |
|---|---|---|---|
| 2812594 | 10/1978 | Fed. Rep. of Germany | 418/55 |

*Primary Examiner*—John J. Vrablik

*Attorney, Agent, or Firm*—Schuyler, Banner, Birch, McKie & Beckett

[57] ABSTRACT

A scroll type fluid displacement apparatus is disclosed. The apparatus includes a housing. A fixed scroll member is fixedly disposed within the housing and comprises a first end plate means from which a first wrap means extends. An orbiting scroll member comprises a second end plate means from which a second wrap means extends, and is supported for orbiting motion within the housing. Both wrap means interfit at an angular and radial offset to make a plurality of line contacts to define at least one pair of symmetrically disposed, sealed off fluid pockets. The first end plate means is formed with two holes which are placed at symmetrical positions to be simultaneously closed by the axial end surface of the second wrap means. These two holes are connected to one another by a passage means. The pressure in the sealed off fluid pockets is thereby equalized at the time the pockets are sealed.

8 Claims, 11 Drawing Figures

SCROLL TYPE FLUID DISPLACEMENT APPARATUS WITH PRESSURE COMMUNICATING PASSAGE BETWEEN POCKETS

BACKGROUND OF THE INVENTION

This invention relates to fluid displacement apparatus, and more particularly, to fluid compressor unit of the scroll type.

Scroll type fluid displacement apparatus are well known in the prior art. For example, U.S. Pat. No. 801,182 discloses a device including two scroll members each having an circular end plate and a spiroidal or involute spiral element. These scroll members are maintained angularly and radially offset so that both spiral elements interfit to make a plurality of line contacts between both spiral curved surfaces, thereby to seal off and define at least one pair of fluid pockets. The relative orbital motion of the two scroll members shifts the contact along the spiral curved surfaces and, therefore, the fluid pockets change in volume. The volume of the fluid pockets increase or decreases dependent on the direction of the orbiting motion. Therefore, the scroll type apparatus is applicable to compress, expand or pump fluids.

Typically in such scroll type fluid displacement apparatus, a pair of fluid pockets, which are defined by the line contacts between the interfitted spiral elements and the axial contacts between the axial end surface of spiral element and end plate, are formed symmetrically. The manner of forming the fluid pockets and the principle of operation of scroll type compressor unit will be described with reference to FIGS. 1*a*–1*d*. These figures may be considered to be end views of a compressor wherein the end plates are removed and only spiral elements are shown.

Two spiral elements 1 and 2 are angularly offset and interfit with one another. So that, as shown in FIG. 1*a*, the orbiting spiral element 1 and fixed element 2 make four line contacts as shown at four points A–D. For purposes of discussion, FIG. 1*a* is considered the starting point of orbiting at 0°. A pair of fluid pocket 3*a* and 3*b* are symmetrically defined between line contacts D–C and line contacts A–B as shown by the dotted regions. The pair of fluid pockets 3*a* and 3*b* are defined not only by the walls of spiral elements 1 and 2 but also by the end plates from which these spiral elements extend. When orbiting spiral element 1 is moved in relation to fixed spiral element 2, in such a manner that the center 0′ of orbiting spiral element 1 revolves around the center 0 of fixed spiral element 2 with a radius of 0–0′ and the rotation of orbiting spiral element 1 is prevented, the location of the pair of fluid pockets 3*a* and 3*b* shifts angularly and radially towards the center of the interfitted spiral elements with the volume of each fluid pocket 3*a* and 3*b* being gradually reduced, as shown in FIGS. 1*a*–1*d*. Therefore, the fluid in each fluid pocket 3*a*, 3*b* is compressed.

The pair of fluid pockets 3*a* and 3*b* connect to one another while passing the stage from FIG. 1*c* to FIG. 1*d*, and after rotation through a 360° angle as shown in FIG. 1*a*, both pockets 3*a* and 3*b* are disposed at the center portion 5 and are completely connected to one another to form a single pocket. The volume of the connected single pocket is further reduced by further revolution of 90° as shown in FIGS. 1*b* and 1*c*. During the course of rotation outer spaces which open in the state shown in FIG. 1*b* change, as shown in FIGS. 1*c*, 1*d* and 1*a*, to form new sealed off pockets in which fluid is newly enclosed as shown in FIG. 1*a*.

Accordingly, if circular end plates are disposed on, and sealed to, the axial faces of spiral elements 1 and 2, respectively, and if one of the end plates is provided with a discharge port 4 at the center thereof as shown in the figures, fluid is taken into the fluid pockets at the radial outer portions and is discharged from the discharge port 4 after compression.

During the formation of the pair of sealed off fluid pockets, a pressure differential might arise between the symmetrically disposed fluid pockets. This pressure differential could arise because of the particular formation and configuration of the fluid inlet portion which is formed through the end plate of fixed scroll member, for example, when the fluid inlet portion is formed at only one location in the end plate. Another cause of the pressure differential could be non-uniform sealing of both fluid pockets resulting from manufacturing inaccuracy or wear of the scroll members. When the pressure difference between the symmetrically disposed fluid pockets arises, vibration of the apparatus will be caused by the unbalance of pressure between the fluid pockets, or irregular motion of the moving parts will be caused by the unbalanced pressure acting on the scroll members.

SUMMARY OF THE INVENTION

It is a primary object of this invention to provide an improvement in a scroll type fluid displacement apparatus which keeps a pressure balance between a symmetrically disposed pair of fluid pockets.

It is another object of this invention to provide a scroll type fluid displacement apparatus which is simple in construction and production and accomplishes the above described object.

A scroll type fluid displacement apparatus according to this invention includes a pair of scroll members. Each scroll member is comprises of an end plate means and a wrap means extending from a side surface of the end plate means. The two wrap means interfit at an angular offset to make a plurality of line contacts and to define at least one pair of sealed off fluid pockets between the wrap means. One of the scroll members undergoes orbital motion by the rotation of a drive shaft, while the rotation of the scroll member is prevented. In this manner, the fluid pockets shift in the direction of orbital motion to change the volume of the fluid pockets. One of end plate means is formed with two holes which are placed in symmetrical positions for the other wrap means to simultaneously cross over the holes. A fluid passage means is formed in this end plate means to provide fluid communication between the two holes. The pair of fluid pockets are connected to one another at the moment the fluid pockets are sealed off, as shown in FIG. 1*a*, and this state continues until both holes are simultaneously sealed by the other wrap means. The pressure difference between the symmetrical pair of fluid pockets is thereby minimized.

Further objects, features and other aspects of the invention will be understood from the detailed description of preferred embodiments of this invention with reference to the annexed drawings.

DETAILED DESCRIPTION OF A PREFERRED EMBODIMENT

Figure 2:
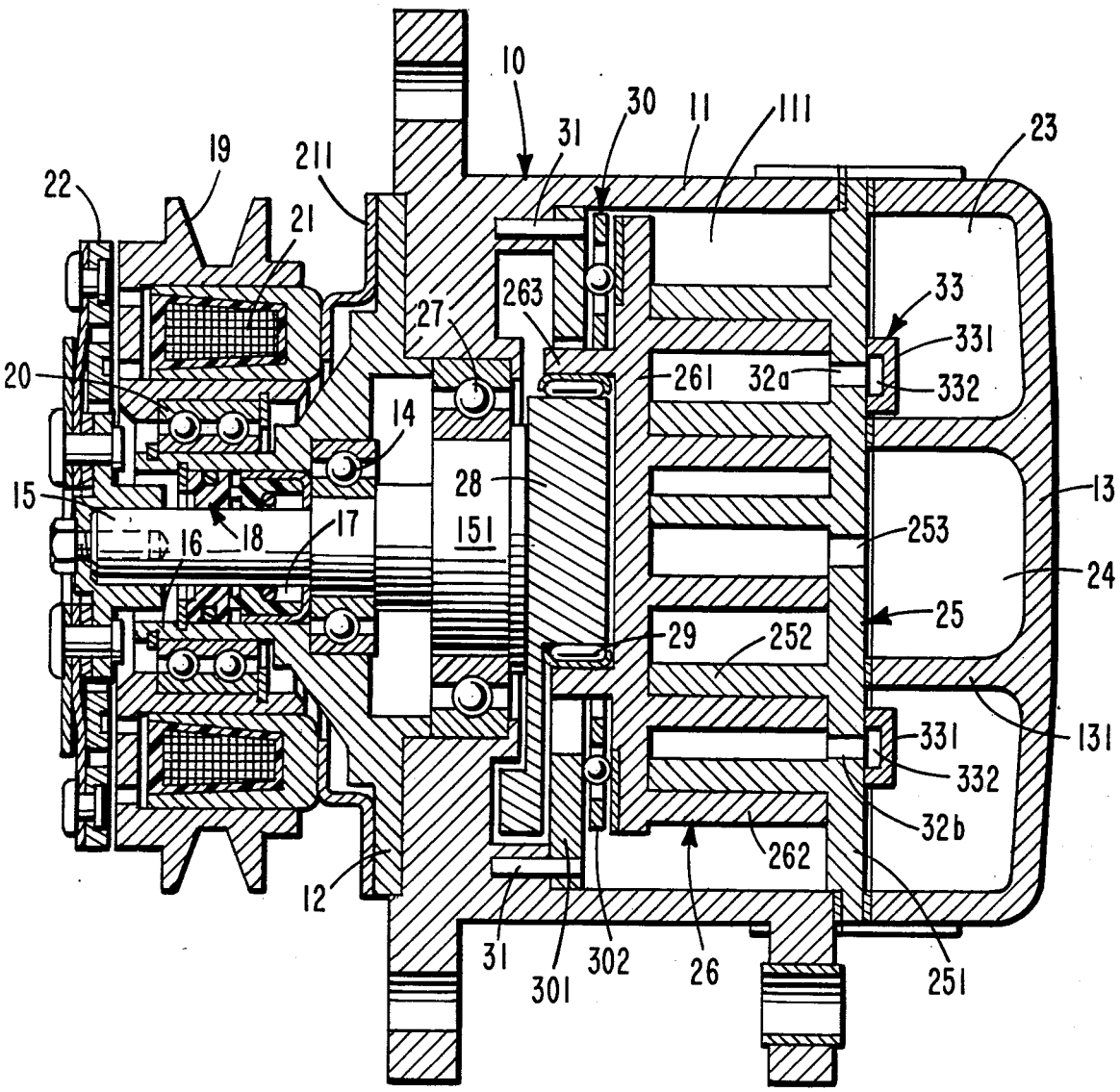
FIG. 2 is a vertical sectional view of a compressor unit of the scroll type according to an embodiment of this invention.

Referring to FIG. 2, a fluid displacement apparatus, in particular, a referigerant compressor unit of an embodiment of the present invention is shown. The unit includes a compressor housing 10 comprising a cylindrical housing 11, a front end plate 12 disposed to front end portion of cylindrical housing 11 and a rear end plate 13 disposed to rear end portion of cylindrical housing 11. An opening is formed in front end plate 12 and a drive shaft 15 is rotatably supported therein by a bearing means, such as a ball bearing 14 which is disposed in the opening. Front end plate 12 has an annular sleeve portion 16 projecting from the front surface thereof and surrounding drive shaft 15 to define a shaft seal cavity 17. A shaft seal assembly 18 is assembled on drive shaft 15 within shaft seal cavity 17. A pulley 19 is rotatably supported by a bearing means 20 which is disposed on an outer surface of sleeve portion 16. An electromagnetic annular coil 21 is fixed to the outer surface of sleeve portion 16 by a support plate 211 and is received in an annular cavity of pulley 19. An armature plate 22 is elastically supported on the outer end of drive shaft 15 which extends from sleeve portion 16. A magnetic clutch comprising pulley 19, magnetic coil 21 and armature plate 22 is thereby formed. Drive shaft 15 is thus driven by an external drive power source, for example, a motor of a vehicle, through a rotational force transmitting means such as the magnetic clutch.

Front end plate 12 is fixed to the front end portion of cylindrical housing 11 by bolts (not shown) to thereby cover an opening of cylindrical housing, and is sealed by a seal member. Rear end plate 13 are provided with an annular projection 131 on its inner surface to partition a suction chamber 23 from a discharge chamber 24. Rear end plate 13 has a fluid inlet port and a fluid outlet port (not shown), which respectively are connected to the suction and discharge chambers 23, 24. Rear end plate 13, together with a circular end plate 251 of fixed scroll member 25, are fixed to rear end portion of cylindrical housing 11 by bolts-nuts (not shown). Circular plate 251 of fixed scroll member 25 is disposed between cylindrical housing 11 and rear end plate 13 and is secured to cylindrical housing 11. The opening of the rear end portion of cylindrical housing 11 is thereby covered by circular plate 251. Therefore, an inner chamber 111 is sealed to form a low pressure space in cylindrical housing 11.

Fixed scroll member 25 includes circular end plate 251 and a wrap means or spiral element 252 affixed to or extending from one side surface of circular end plate 251. Spiral element 252 is disposed in inner chamber 111 of cylindrical housing 11. A hole or suction port (not shown) which communicates between suction chamber 23 and inner chamber 111 of cylindrical housing 11 is formed through a circular plate 251. A hole or discharge port 253 is formed through circular plate 251 at a position near to the center of spiral element 252 and is connected to discharge chamber 24. An orbiting scroll member 26 is also disposed in inner chamber 111. Orbiting scroll member 26 also comprises a circular end plate 261 and a wrap means or spiral element 262 affixed to or extending from one side surface of circular plate 261. Spiral element 262 and spiral element 252 of fixed scroll member 25 interfit at an angular offset of 180° and at a predetermined radial offset to make a plurality of line contacts and to define at least one pair of sealed off fluid pockets between both spiral elements 252, 262. Orbiting scroll member 26 is connected to a driving mechanism and a rotation preventing mechanism. These last two mechanisms effect orbital motion at a circular radius $R_o$ by rotation of drive shaft 15 to thereby compress fluid in the fluid pockets, as the fluid passes through the compressor unit.

The driving mechanism of orbiting scroll member 26 includes the drive shaft 15, which is rotatably supported by front end plate 12 through ball bearing 14. The drive shaft 15 is formed with a disk portion 151 at its inner end portion. Disk portion 151 is rotatably supported by a bearing means such as a ball bearing 27 which is disposed in a front end opening of cylindrical housing 11. A crank pin or drive pin projects axially from an end surface of disk portion 151, and, hence, from an end surface of drive shaft 15, and is radilly offset from the center of drive shaft 15.

Circular plate 261 or orbiting scroll member 26 is provided with a tubular boss 263 projecting axially from an end surface which is opposite the side thereof from which spiral element 262 extends. A discoid or short axial bushing 28 is fitted into boss 263, and is rotatably supported therein by a bearing means, such as a needle bearing 29. An eccentric hole (not shown) is formed in bushing 28 radially offset from the center of bushing 28. The drive pin in fitted into the eccentrically disposed hole. Bushing 28 in therefore driven by the revolution of the drive pin and permitted to rotate by needle bearing 29. Whereby, orbiting scroll member 26 is allowed to undergo the orbital motion by the rotation of drive shaft 15, while the rotation of orbiting scroll member 26 is prevented by a rotation preventing mechanism 30.

Rotation preventing mechanism 30 is disposed around boss 263 and comprises an Oldham plate 301 and the Oldham ring 302. Oldham plate 301 is secured to a stepped portion of the inner surface of cylindrical housing 11 by pins 31. Oldham ring 302 is disposed in a hollow space between Oldham plate 301 and circular plate 261 of orbiting scroll member 26. Oldham plate 301 and Oldham ring 302 are connected by keys and keyways whereby Oldham ring 302 is slidable in a first radial direction, and Oldham ring 302 and circular plate 261 are also connected by keys and keyways whereby orbiting scroll member 26 is slidable in a second radial direction which is perpendicular to the first radial direction.

Accordingly, orbiting scroll member 26 is slidable in one radial direction with regard to Oldham ring 302, and is slidable in another radial direction independently. The second radial direction is perpendicular to the first radial direction. Therefore, orbiting scroll member 26 is prevented from rotating, but is permitted to move in two radial directions perpendicular to one another.

When drive shaft 15 is rotated by the external drive power source through the magnetic clutch, the drive pin is eccentrically moved by the rotation of drive shaft 15. Eccentric bushing 28 is driven eccentrically because it follows the motion of the drive pin. Therefore, orbiting scroll member 25 is allowed to undergo orbital motion, while the rotation is prevented by rotation preventing mechanism 30. The fluid or, refrigerant gas, introduced into suction chamber 23 through the fluid inlet port, is thereby taken into the fluid pocket formed between both spiral element 252, 262 and, as orbiting scroll member 26 orbits, fluid in the fluid pocket is moved to the center of the spiral elements with a consequent reduction of volume. The compressed fluid is discharged into discharge chamber 24 from the fluid pockets of the spiral elements' center through discharge port 253. The compressed fluid is discharged from the chamber 24 through the outlet port to an external fluid circuit.

Figure 1A:
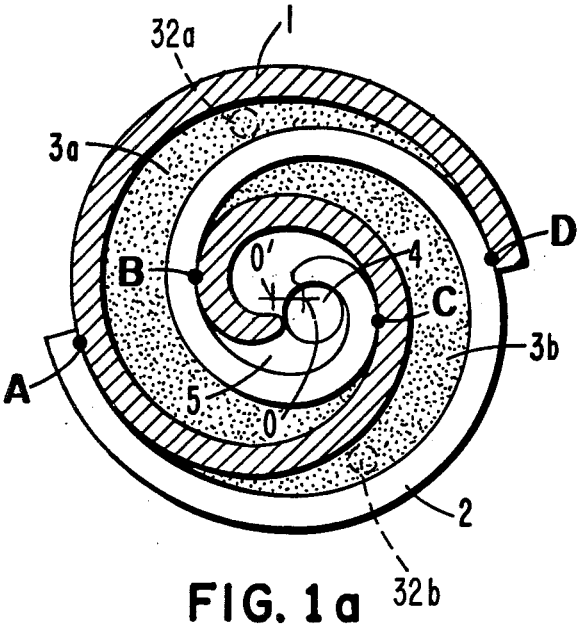
FIGS. 1a–1d are schematic views illustrating the movement of interfitting spiral elements to compress a fluid.
Figure 1B:
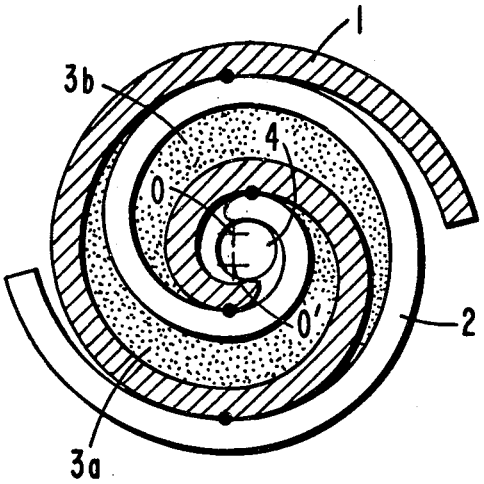
Figure 1C:
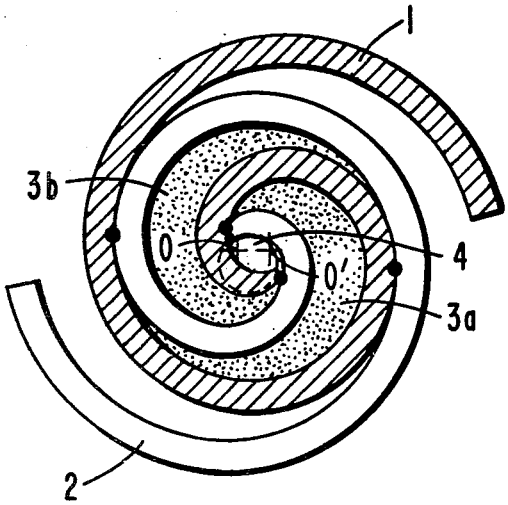
Figure 1D:
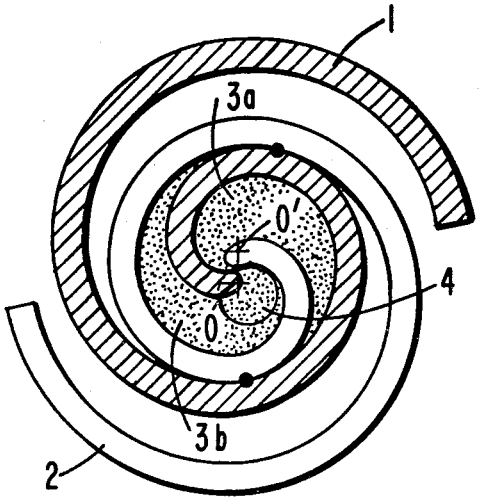
Figure 3:
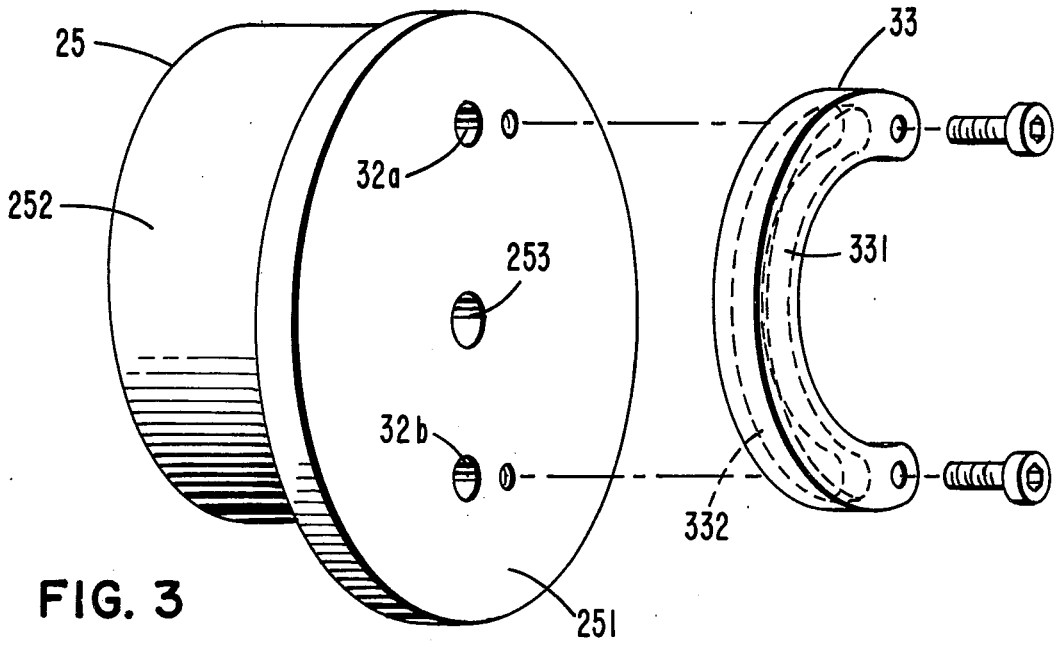
FIG. 3 is an exploded perspective view of a fixed scroll member, illustrating a fluid passage means of the present invention.
Figure 4:
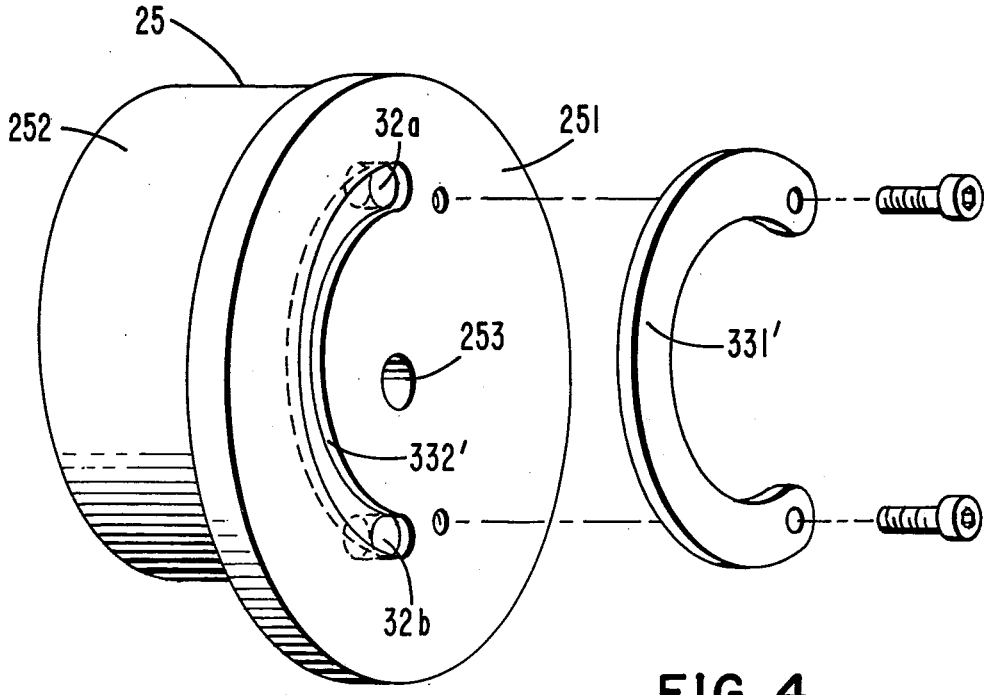
FIG. 4 is an exploded perspective view of a modification of the embodiment of FIG. 3.

Two holes 32*a* and 32*b* are formed in circular plate 251 of fixed scroll member 25 and are connected to one another by a fluid passage means 33 (see FIG. 3). The two holes 32*a*, 32*b* are placed at symmetrical positions so that an axial end surface of spiral element 262 of orbiting scroll member 26 simultaneously crosses over the two holes (see FIG. 5*b*). Also, the holes 32*a*, 32*b* should be in communication with one another through the fluid passage means 33 at the moment the fluid pockets are sealed, as shown in FIG. 1*a*. Fluid passage means 33 is comprised of a passage plate 331, within which is formed a passageway 332 at one of its side surfaces. Passage plate 331 is fixed to the end surface of end plate 251 by screws, as shown in FIG. 3. Alternatively, a passageway 332' may be formed in the circular plate 25, and covered by the plate 331', as shown in FIG. 4.

Referring to FIG. 1 and FIG. 5, the operation of the two holes and fluid passage means will be described. For simplicity, explanation is done with a straight passageway 332 in FIG. 5 while its actual shape is arcuate.

Figure 5A:
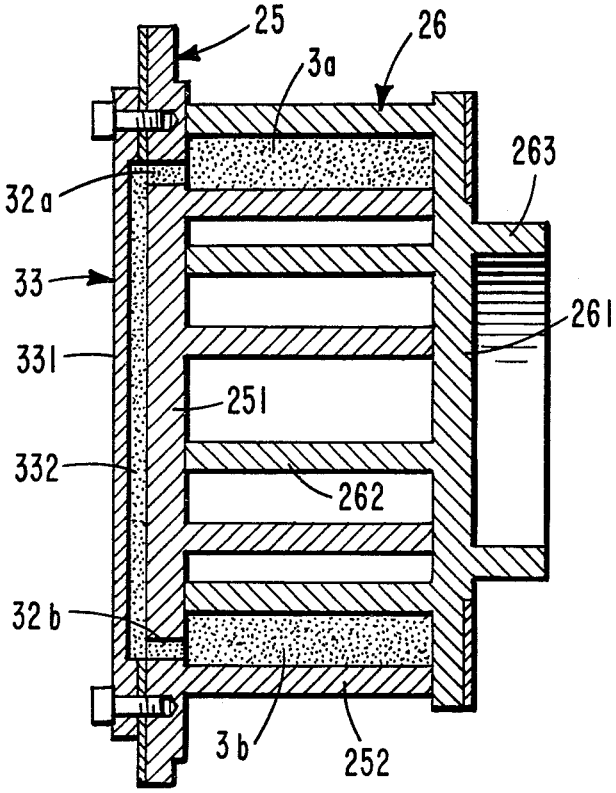
FIGS. 5a–5d are schematic views illustrating the operation of the fluid passage means.
Figure 5B:
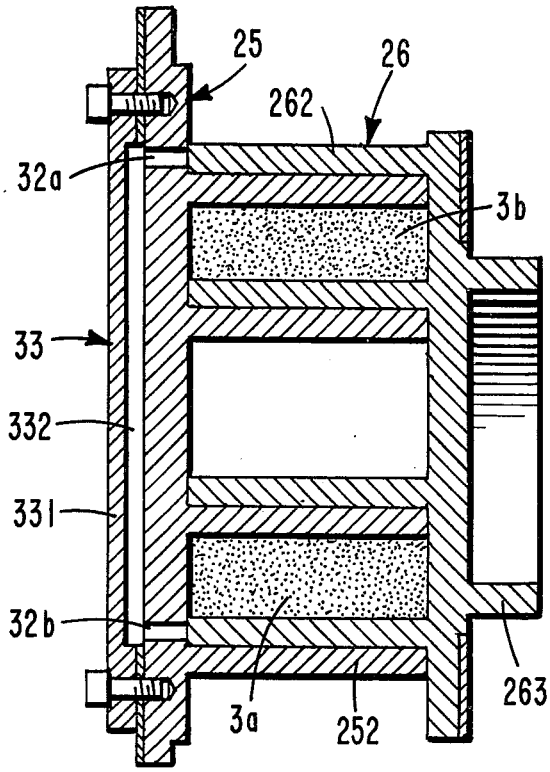
Figure 5C:
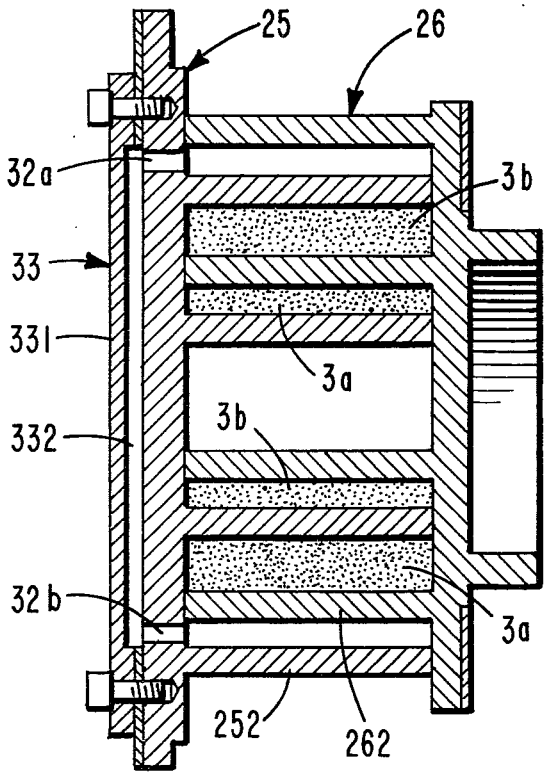
Figure 5D:
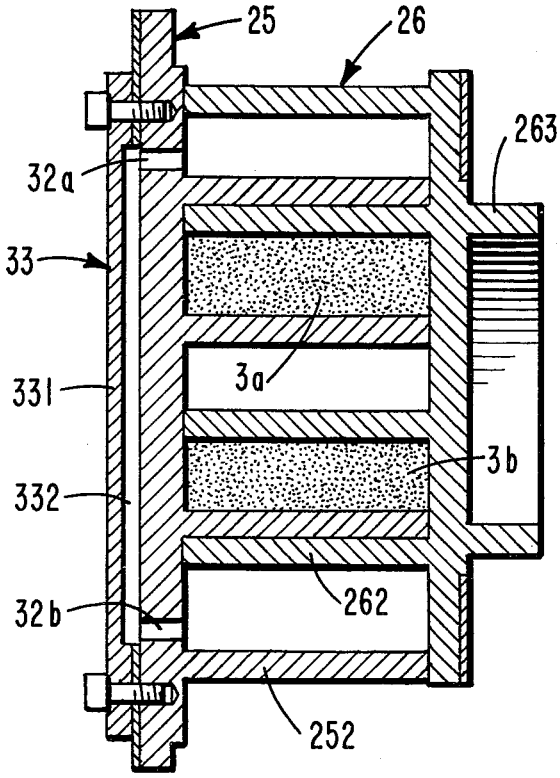

When the terminal end portion of both spiral elements 252, 262 fit against or makes contact with the opposite side wall of the other spiral element 262, 252 because of the orbital motion of orbiting scroll member 26, as shown in FIG. 1*a*, a pair of fluid pockets 3*a*, 3*b* are sealed off and are symmetrically formed at the same time. At this time, the pair of fluid pockets 3*a*, 3*b* are connected to one another by passageway 332 of fluid passage means 33 through two holes 32*a*, 32*b*, as shown in FIG. 5*a*. The fluid pressure in the pair of fluid pockets 3*a*, 3*b* is therefore equalized. As orbiting scroll member 26 orbits, the two holes 32*a*, 32*b* are closed by the axial end surface of spiral element 262 of orbiting scroll member 26 at the same time at a certain orbital angle, as shown in FIG. 5*b*. The connected stage between the pair of fluid pockets 3*a*, 3*b* is thereby finished and the compression stroke of each fluid pocket proceeds respectively, as shown in FIGS. 5*c* and 5*d*.

According to this construction, two symmetrically formed fluid pockets are connected to one another by fluid passage means and two holes during a certain orbital angle of orbiting scroll member, i.e., until both holes are simultaneously sealed by the spiral element 262. Therefore, the fluid pressure in the symmetrical pair of fluid pockets is equalized. The vibration of the compressor unit or irregular motion of the moving parts, which could be caused by unbalance of fluid pressure in the pair of fluid pockets can thereby be minimized.

This invention has been described in detail in connection with the preferred embodiments, but these are examples only and this invention is not restricted thereto. It will be easily understood by those skilled in the art that the other variations and modifications can be easily made within the scope of this invention.

We claim:

1. In a scroll type fluid displacement apparatus including a housing, a fixed scroll member fixedly disposed relative to said housing and having a first end plate from which a first wrap extends into the interior of said housing, an orbiting scroll member having a second end plate from which a second wrap extends, said first and second wraps interfitting at an angular and radial offset to make a plurality of line contacts to define at least one pair of sealed off fluid pockets, a driving mechanism including a drive shaft rotatably supported by said housing and connected to said orbiting scroll member to effect the orbital motion, and a rotation preventing mechanism connected to said orbiting scroll member to prevent the rotation of said orbiting scroll member during the orbital motion of said orbiting scroll member, whereby said fluid pockets change volume by the orbital motion of said orbiting scroll member, the improvement comprising equalizing means for minimizing fluid pressure difference between said pair of fluid pockets and thereby reducing vibration in the apparatus, said equalizing means including two holes formed in said end plate of said fixed scroll member at symmetrical locations so that said wrap of said orbiting scroll member simultaneously crosses over said two holes, and a fluid passage means for placing said two holes in continuous fluid communication with one another.

2. The improvement as claimed in claim 1 wherein said fluid passage means comprises a passage plate within which is formed a passageway at one of its side surfaces.

3. The improvement as claimed in claim 1 wherein said fluid passage means is comprised of a passageway which is formed in said fixed end plate of said fixed scroll member.

4. The improvement as claimed in claim 1 wherein said holes are located in the area where said fluid pockets are initially formed so that the pair of fluid pockets are placed in fluid communication with one another when said fluid pockets are initially formed.

5. A scroll type fluid displacement apparatus comprising:

a housing;

a fixed scroll member fixedly disposed relative to said housing and having a first end plate from which a first wrap extends into the interior of said housing;

an orbiting scroll member having a second end plate from which a second wrap extends, and said first and second wraps interfitting at an angular and radial offset to make a plurality of line contacts to define at least one pair of sealed off fluid pockets;

a driving mechanism including a drive shaft rotatably supported by said housing and connected to said orbiting scroll member to effect orbital motion of said orbiting scroll member by the rotation of said drive shaft;

rotation preventing means connected to said orbiting scroll member for preventing the rotation of said orbiting scroll member during the orbital motion of said orbiting scroll member; and equalizing means for minimizing fluid pressure difference between said pair of fluid pockets and thereby reducing vibration in this apparatus, said equalizing means including two holes formed in said first end plate and fluid passage means for placing said two holes in continuous fluid communication with one another, said holes being located at symmetrical positions for said second wrap to simultaneously cross over the two holes.

6. A scroll type fluid displacement apparatus as claimed in claim 4 wherein said fluid passage means is comprised of a passage plate within which is formed a passageway at one of its side surfaces, said passage plate being attached to said first end plate to place said holes in communication with one another.

7. A scroll type fluid displacement apparatus as claimed in claim 4 wherein said fluid passage means is comprised of a fluid passageway which is formed in said first end plate to place said holes in communication with one another.

8. A scroll type fluid displacement apparatus comprising:

a housing;

a fixed scroll member fixedly disposed relative to said housing and having a first end plate from which a first wrap extends into the interior of said housing;

an orbiting scroll member having a second end plate from which a second wrap extends, and said first and second wraps interfitting at an angular and radial offset to make a plurality of line contacts to define at least one pair of sealed off fluid pockets;

a driving mechanism including a drive shaft rotatably supported by said housing and connected to said orbiting scroll member to effect orbital motion of said orbiting scroll member by the rotation of said drive shaft;

rotation preventing means connected to said orbiting scroll member for preventing the rotation of said orbiting scroll member during the orbital motion of said orbiting scroll member; and equalizing means for minimizing fluid pressure difference between said pair of fluid pockets and thereby reducing vibration in the apparatus, said equalizing means including two holes formed in said first end plate and fluid passage means for placing said two holes in continuous fluid communication with one another, said holes being located at symmetrical positions for said second wrap to simultaneously cross over the two holes and in the area where said fluid pockets are initially formed so that the pair of fluid pockets are placed in fluid communication with one another when said fluid pockets are initally formed.

* * * * *

UNITED STATES PATENT AND TRADEMARK OFFICE

CERTIFICATE OF CORRECTION

PATENT NO. : 4,432,708
DATED : February 21, 1984
INVENTOR(S) : Masaharu Hiraga and Seiichi Sakamoto It is certified that error appears in the above—identified patent and that said Letters Patent is hereby corrected as shown below:

In Claim 6, column 7, line 12, after "claim" delete "4" and insert --5--; and

In Claim 7, column 7, line 18, after "claim" delete "4" and insert --5--.

Signed and Sealed this

*Twenty-second* Day of *May 1984*

[SEAL]

*Attest:*

GERALD J. MOSSINGHOFF

*Attesting Officer*

*Commissioner of Patents and Trademarks*